US005598726A

United States Patent [19]

Cordle

[11] Patent Number: 5,598,726

[45] Date of Patent: Feb. 4, 1997

[54] PRIVACY LOCKSET FOR A DOOR

[75] Inventor: William H. Cordle, San Mateo, Calif.

[73] Assignee: Schlage Lock Company, San Francisco, Calif.

[21] Appl. No.: 622,909

[22] Filed: Mar. 29, 1996

[51] Int. Cl.[6] ..... G05G 5/00

[52] U.S. Cl. ..... 70/224; 70/461; 70/476; 292/336.3

[58] Field of Search ..... 70/224, 461, 467, 70/469, 476, 480, 481, 482, 487; 292/336.3, DIG. 60, DIG. 37

[56] References Cited

U.S. PATENT DOCUMENTS

| | | | |
|---|---|---|---|
| 2,018,093 | 10/1935 | Schlage | 70/91 |
| 2,218,178 | 10/1940 | Schlage | 70/150 |
| 2,226,499 | 12/1940 | Ledin | 70/216 |
| 2,242,508 | 5/1941 | Ching | 292/DIG. 37 |
| 2,293,856 | 8/1942 | Schlage | 70/480 |
| 2,307,110 | 1/1943 | Chesler | 292/169 |
| 2,650,122 | 8/1953 | Welch | 292/169 |
| 2,650,123 | 8/1953 | Hopgood | 292/169 |
| 2,719,424 | 10/1955 | Rayburn | 70/224 |
| 2,788,996 | 4/1957 | Shoalts | 292/336.3 |
| 2,841,432 | 7/1958 | Ahlquist et al. | 292/169 |
| 3,128,115 | 4/1964 | Patriquin et al. | 292/336.3 |
| 3,232,653 | 2/1966 | Wilson | 292/169 |
| 3,425,247 | 2/1969 | Etter | 70/150 |
| 3,604,229 | 9/1971 | Wake | 70/107 |
| 3,823,585 | 7/1974 | Spon | 70/146 |
| 3,955,387 | 5/1976 | Best et al. | 70/224 |
| 4,201,069 | 5/1980 | Katayama et al. | 70/422 |
| 4,428,212 | 1/1984 | Best et al. | 70/224 |
| 4,428,570 | 1/1984 | Foshee et al. | 267/164 |
| 4,470,278 | 9/1984 | Hale et al. | 70/134 |
| 4,470,279 | 9/1984 | Neary et al. | 70/134 |

*Primary Examiner*—Steven N. Meyers
*Assistant Examiner*—Donald J. Lecher
*Attorney, Agent, or Firm*—B. Franklin Griffin, Jr.; Robert F. Palermo

[57] ABSTRACT

A lockset suitable for use on doors of different thicknesses comprises inside and outside knobs mounted on inside and outside spindles which are in turn rotatably supported in inside and outside chassis. Rotation of either knob causes rotation of a rectangular driver spindle to drive a latch operating assembly which retracts a latchbolt. Locking may be accomplished only by pressing a push button located in the inside knob. In one embodiment the push button drives a caliper spring to engage and axially move a plunger bar and in a second embodiment a hook spring carried on the push button engages teeth on the plunger bar. Axial movement of the plunger bar actuates a clutch mechanism to disconnect the outside knob from the driver spindle and lock the outside knob to the outside chassis to prevent rotation of the knob. In the first embodiment unlocking is accomplished by rotating the plunger bar relative to a coupler having a spring thereon for engaging notches on the plunger bar. The unlocking may be accomplished with a key from the outside or by turning the inside knob. In the second embodiment unlocking is accomplished from the inside by turning a knob to rotate the plunger bar and from the outside unlocking is accomplished by turning a key to rotate the coupler. Both embodiments may be mounted on doors of various thicknesses without any adjustment prior to mounting. The second embodiment permits hands free installation.

26 Claims, 8 Drawing Sheets

PRIVACY LOCKSET FOR A DOOR

FIELD OF THE INVENTION

The present invention relates to improvements in locksets operable to provide a privacy function and suitable for use on doors having different thicknesses. More particularly, the invention provides a lockset which may be locked only from the inside by pressing a push button provided in an inside knob, and may be unlocked from the outside with a key or from the inside by rotating a knob, the lockset automatically adjusting to the thickness of a door on as it is installed on the door.

BACKGROUND OF THE INVENTION

U.S. Pat. No. 3,823,585 describes a privacy lockset which may be locked only from the inside by pressing a push button and unlocked from the inside by rotating a knob or from the outside by turning a key. In the described lockset the driver spindle which drives the latch operating mechanism is always in driving engagement with the outside knob. Pressing of the push button causes a plunger to interlock the driver spindle with an inside clamp plate. The device includes many parts, making it expensive to manufacture.

Neary et al. U.S. Pat. No. 4,470,279 discloses a lockset which may be locked by pressing an inside push button. The push button drives a locking mechanism which links the outside knob to the inside chassis so that the outside knob will not turn. The lockset has no outside lock but a hole is provided in the outside knob for the insertion of a pick or special tool to unlock the lockset from the outside in case of an emergency. The pick moves a plunger bar axially and a tapered end of the plunger bar cams a locking element out of locking position thereby releasing the push button and unlocking the lockset.

Hale et al. U.S. Pat. No. 4,470,278 discloses a lockset wherein the locking function is accomplished by rotating a plunger bar, either by rotating a thumb-turn button located in the inside knob or rotating a lock plug in the outside knob with a key. Rotation of the plunger bar is translated into linear axial movement of a locking element which engages slots in an outside spindle and slots in an outside chassis to thereby lock the outside knob against rotation. Unlocking is accomplished by rotating the plunger bar by means of the thumb-turn button or by rotation of the lock plug in the outside knob.

SUMMARY OF THE INVENTION

An object of the present invention is to provide a privacy lockset for a door, the lockset being characterized in that it requires fewer parts than prior art locksets even though it may be locked only by pressing an inside lock button and unlocked by rotation of an inside knob or by a key from the outside.

An object of the invention is to provide a lockset suitable for use on doors of different widths, the lockset requiring no door-width compensating adjustments prior to mounting on a door and automatically adjusting to the thickness of a door as it is mounted thereon.

Another object of the invention is to provide a lockset as described above wherein locking is accomplished by axial movement of a plunger bar and unlocking is accomplished by rotation of the plunger bar.

A further object of the invention is to provide a lockset having a plunger bar movable in an axial direction in response to the pressing of a push button to cause locking of an outside knob against rotation, and a caliper spring responsive to axial movement of the push button for grasping teeth provided on the plunger bar to thereby axially move the plunger bar.

According to a first embodiment, a coupler and a hook spring are mounted on a rectangular plunger bar so as to rotate and move axially therewith. When the lockset is in an unlocked state, a locking slide couples the outside knob to a latch operating mechanism so that rotation of the outside knob retracts the latch. In the locked state, achieved by pressing a push button in the inside knob, the outside knob is uncoupled from the latch operating mechanism and is coupled to the outside chassis to prevent rotation of the outside knob. The hook spring engages notches in the plunger bar and has elbows which engage openings in an outside spindle when the plunger bar has been moved to the locking position so that the plunger bar and locking slide are held in the locking position. The lockset is unlocked when the plunger bar and coupler are rotated to move the elbows out of the openings in the outside spindle. A compression spring returns the plunger bar, locking slide, coupler and hook spring to the unlocked state. Rotation of the plunger bar is accomplished either by rotation of the inside knob or by rotation of a key in a lock plug provided in the outside knob. In the unlocked state, the plunger bar is not axially movable by the outside knob or lock plug hence the lockset cannot be locked from the outside.

In a second, preferred embodiment, the plunger bar may rotate or move axially relative to the coupler and hook spring. Locking is accomplished only by pressing the push button in the inside knob to axially move the plunger bar so that the hook spring engages notches in the plunger bar. Unlocking is accomplished by rotating the plunger bar or the coupler and hook spring so that the hook spring disengages from the notches. The coupler and hook spring rotate in response to rotation of the lock plug in the outside knob and the plunger bar rotates in response to rotation of the inside knob.

In the preferred embodiment, the push button is provided with a second hook spring and coupler and the inside end portion of the plunger bar is provided with teeth that are engaged by the second hook spring as the inside and outside chassis assemblies of the lockset are placed against opposing faces of a door. This couples the assemblies so that the installer may have both hands free to insert and tighten screws which hold the assemblies together against opposing faces of the door. As the inside and outside assemblies are pressed against opposite surfaces of the door the lockset automatically adjusts to the thickness of the door.

Other objects and advantages of the invention and the manner of making and using it will become evident upon consideration of the following description and the accompanying drawings.

DESCRIPTION OF THE PREFERRED EMBODIMENTS

Figure 1:
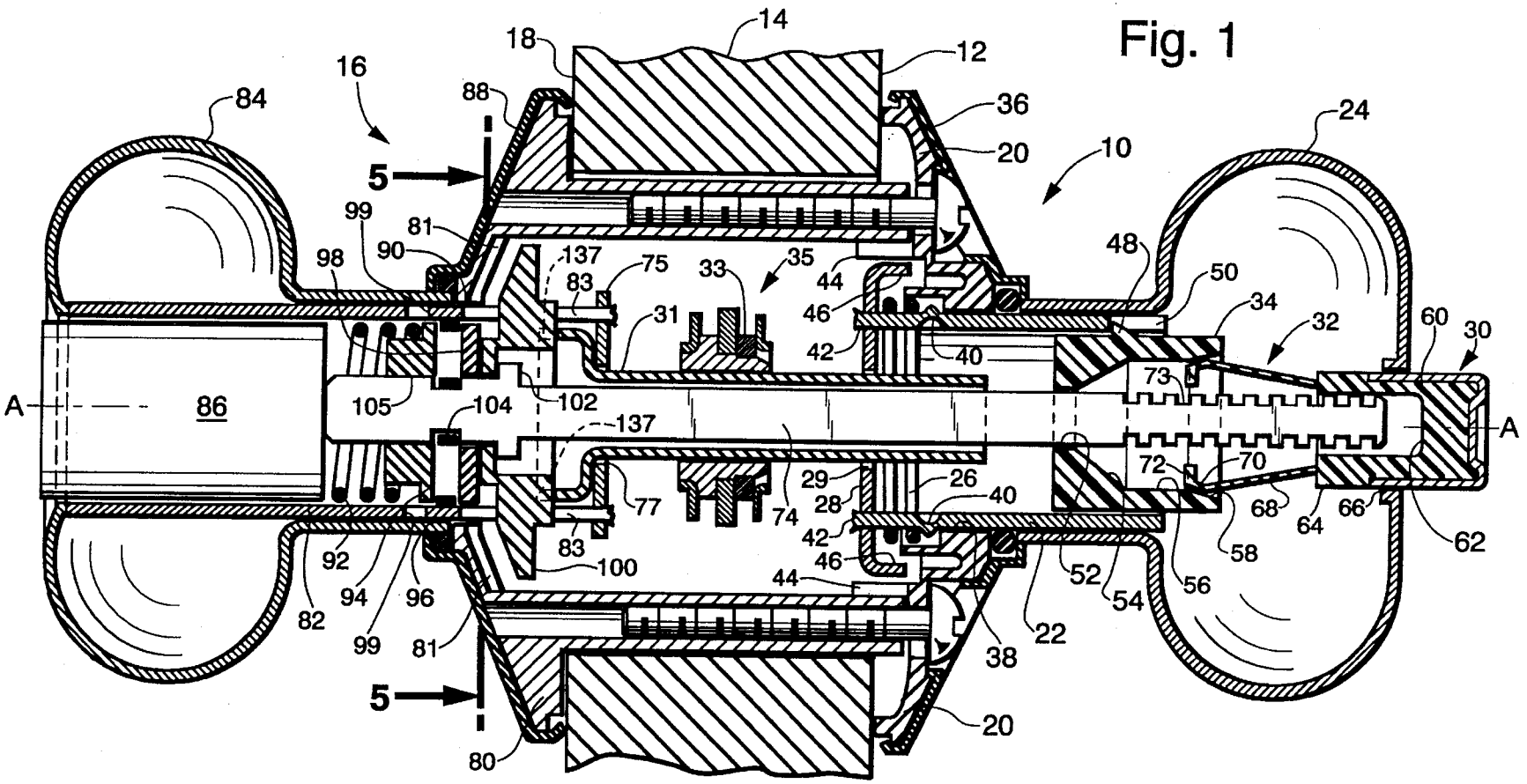
FIG. 1 is a sectional view of a first embodiment of the lockset, the lockset being shown in the unlocked state.
Figure 2:
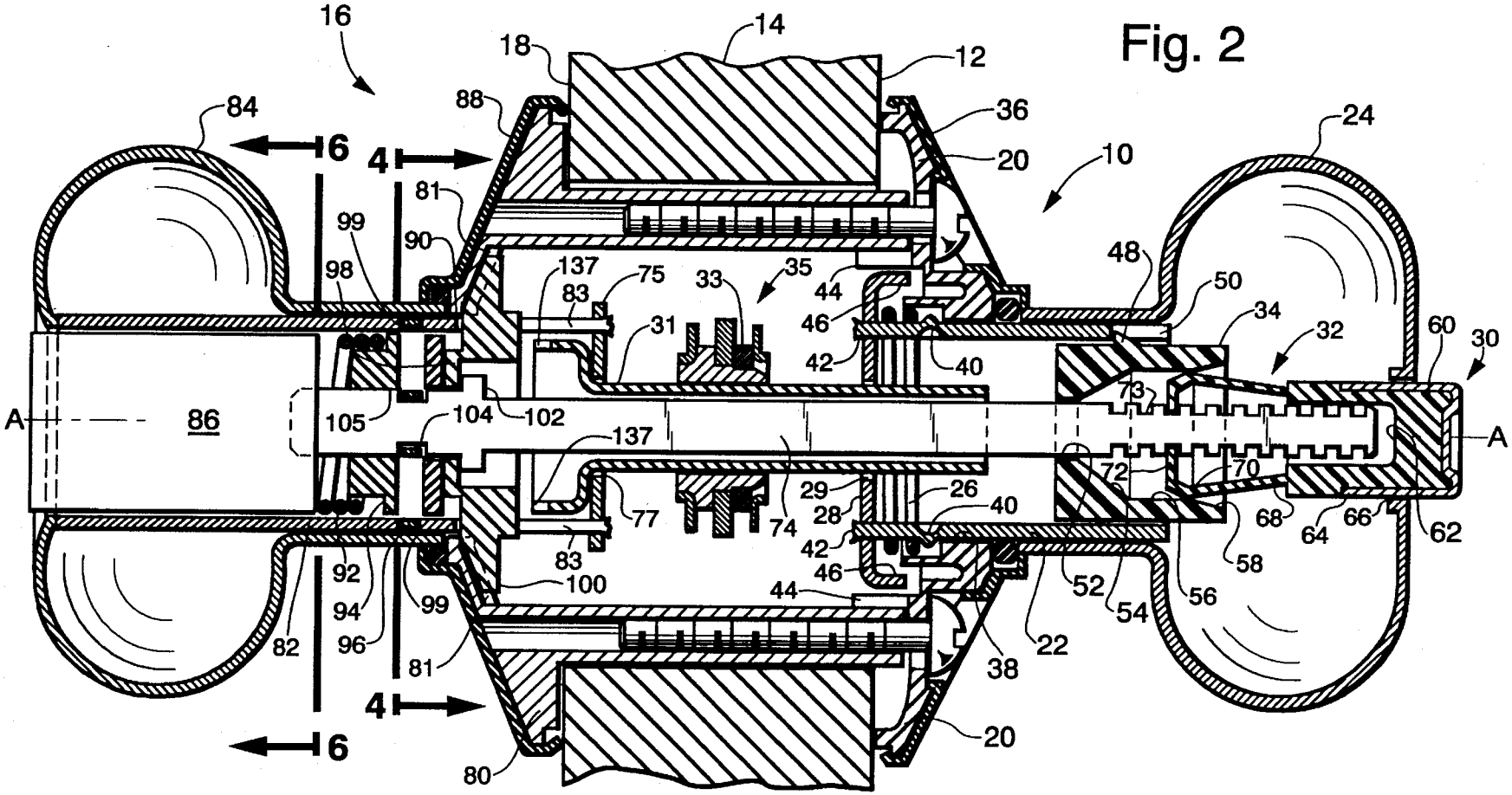
FIG. 2 is a sectional view of the first embodiment, the lockset being shown in the locked state.

As shown in FIGS. 1 and 2, a lockset according to a first embodiment of the invention comprises an inside chassis assembly 10 mounted to the inside surface 12 of a door 14, and an outside chassis assembly 16 mounted to the outside surface 18 of the door.

The inside chassis assembly 10 comprises an inside chassis 20, an inside spindle 22, an inside knob 24, a torsion spring 26, a spring cage 28, a push button 30, a caliper spring 32, a push button housing 34 and a brass or other decorative element 36 covering the chassis 20. Spindle 22 is rotatably mounted in an opening 38 provided in the chassis 20 and the spindle is provided with a plurality of outwardly extending ridges 40 which engage the portion of chassis 20 surrounding opening 38 so as to limit movement of the spindle to the right as viewed in FIG. 1. Knob 24 is retained on spindle 22 in a conventional manner, either by swaging or a key and slot arrangement so that the spindle rotates as the knob is turned.

The torsion spring 26 surrounds spindle 22 and is held on the spindle by the spring cage 28. The spring cage has two arcuate openings through which two ears 42 of the spindle extend. After the cage is mounted on the ears 42, the ears are swaged to thereby secure the cage and the torsion spring 26 on the spindle 22. As explained in U.S. Pat. No. 4,470,278, the ends of torsion spring 26 normally engage projecting locator troughs 44 provided on chassis 20 when no rotational force is applied to knob 24. As knob 24 is turned to rotate spindle 22 and cage 28, an axially extending leg 46 of the cage moves one end of spring 26 so that energy is stored in the spring for returning the spindle and knob to a home position when the knob is released.

Spring cage 28 is provided with a rectangular opening 29 and a hollow rectangular driver spindle 31 extends through opening 29. The spindle 31 also extends through a rectangular opening in a lever 33 which comprises part of a latch operating assembly 35. The latch operating assembly may be of the type shown in U.S. Pat. No. 4,470,279 and operates in a well known manner to retract a latch (not shown) when the driver spindle 31 rotates.

In accordance with one aspect of the present invention a novel push button locking arrangement comprises the push button 30, the caliper spring 32 and the push button housing 34.

The push button housing 34 is a generally cylindrical element mounted in the spindle 22. A projection 48 extends radially outwardly on the housing 34 and engages a slot 50 provided in spindle 22. The projection 48 limits movement of housing 34 into the spindle and also causes housing 34 to rotate when spindle 22 rotates. Housing 34 is provided with an axially extending opening having a rectangular cross-section. The opening has a first portion 52 which is slightly larger than the cross-sectional dimensions of a generally rectangular plunger bar 74 so that the plunger bar may freely move in the direction of axis A through the housing 34. From portion 52, opposing walls of the opening diverge as indicated at 54, and then extend parallel to each other in the axial direction as indicated at 56. From the ends of the parallel walls 56, the opposing walls again diverge from each other to define two opposing camming surfaces 58.

Push button 30 extends through a circular opening 66 in knob 24 and may comprise a cylindrical plastic body 64 having a rectangular opening 62 extending axially into the body from one end. The dimensions of opening 62 are slightly larger than the cross-sectional dimensions of plunger bar 74 so that the push button and plunger bar rotate together but relative movement between the push button and the plunger bar may take place in the axial direction.

Body 64 is capped by a metal decorative cover 60 and the cover may be provided with radially extending tangs (not shown) for retaining the push button in the knob 24.

Caliper spring 32 may be molded into the plastic body 64. The spring comprises two arms each having a first portion 68 which diverges from axis A, a camming portion 70 for engaging the push button housing 34, and a plunger bar engaging portion 72 extending toward the axis A from the camming portion for engaging teeth 73 provided on opposing edges of the plunger bar 74.

FIG. 1 shows caliper spring 32 in the position it occupies when the lockset is not locked, that is, when the push button 30 is not pressed inwardly of knob 24. At this time the camming portions 70 of the caliper spring engage the camming surfaces 58 of the push button housing 34. As the push button 30 is pressed inwardly (to the left as viewed in FIG. 1) the camming portions 70 slide along surfaces 58 and the arms of the spring are forced inwardly toward the axis A so that the plunger bar engaging portions 72 move into opposing notches between teeth 73 in the plunger bar 74. As the push button 30 is pressed further inwardly, the spring arms move along the parallel walls 56 and the plunger bar engaging portions 72 move the plunger bar to the left until the lockset is locked as subsequently described. FIG. 2 shows the position of the caliper spring 32 when the lockset is locked.

The outside chassis assembly 16 comprises the driver spindle 31, the plunger bar 74, an outside chassis 80, an outside spindle 82, an outside knob 84, a lock cylinder 86 and a decorative element 88 covering the chassis 80. Outside spindle 82 is rotatably supported in a center opening 90 provided in chassis 80 and has radially outwardly extending ridges (not shown but like the ridges 40) for limiting movement of the spindle to the left relative to chassis 80. Outside knob 84 is mounted on spindle 82 in a conventional manner so that the spindle rotates as the knob is turned. A retaining ring 75 is swaged onto the right end of spindle 82 and serves to retain a cup-shaped end portion of driver spindle 31 within the spindle 82. Retaining ring 75 is provided with a central opening 77 large enough to permit rotation of the rectangular driver spindle 31 therein.

Lock cylinder 86 is mounted within the spindle 82 and is of convention design. The lock cylinder includes a lock plug 79 (FIG. 6) and the end of the lock plug facing plunger bar 74 has an irregularly shaped opening 78 formed therein. When the plunger bar 74 is moved axially into opening 78 as subsequently described, the plunger bar may be rotated through 90 degrees about axis A by inserting a key into the lock cylinder and turning the key so as to rotate the lock plug 79 in which the opening 78 is located.

In accordance with a second aspect of the invention, the outside chassis assembly 16 further comprises a coil type plunger spring 92, a washer 94, a hook spring 96, a hook spring/plunger bar coupler 98 and a locking slide 100. In addition, the plunger bar 74 is provided with a pair of opposing projections 102 (FIG. 3) and a pair of opposing notches 104.

Washer 94 is slidable within the spindle 82 and is provided with a circular axial opening 105 through which the plunger bar 74 extends. The opening 105 has a diameter slightly greater than the width of the plunger bar so that the plunger bar may rotate relative to the washer.

Figure 3:
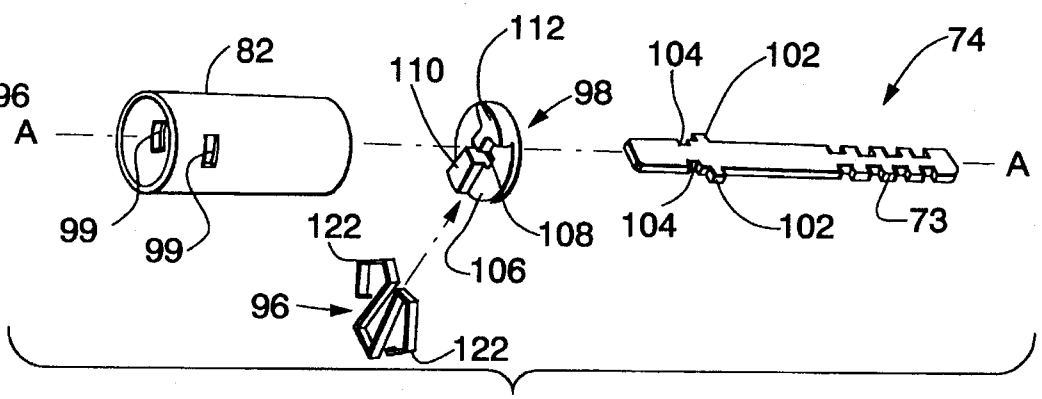
FIG. 3 is an exploded view showing elements of the locking mechanism.
Figure 4:
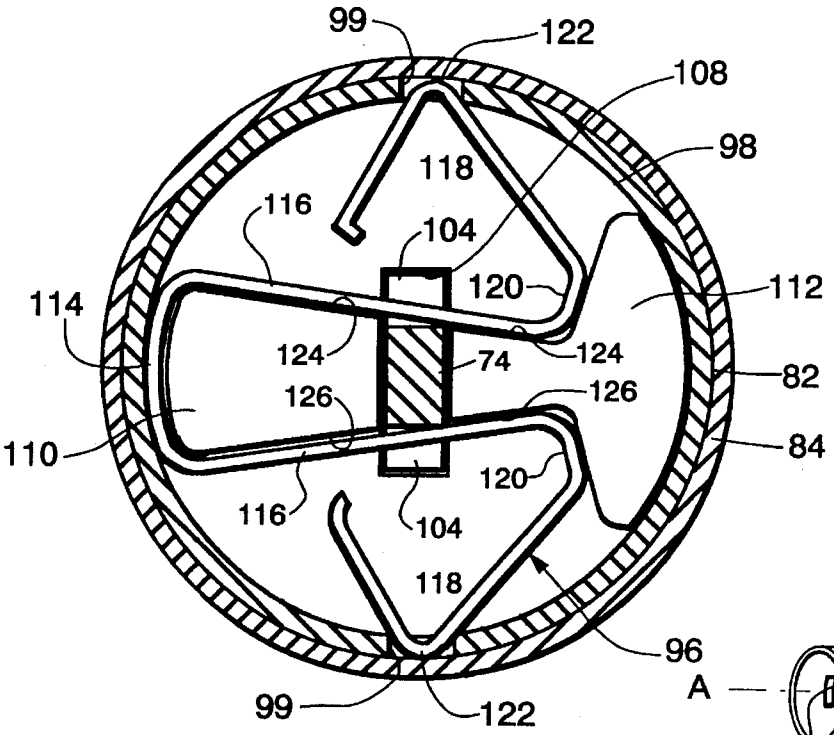
FIG. 4 is a sectional view, taken along the line 4—4 of FIG. 2, showing the hook spring and the spring/plunger bar coupler.

As best seen in FIGS. 3 and 4, the hook spring/plunger bar coupler 98 has a circular disk-like portion 106 with a centrally located rectangular opening 108 therein. Portion 106 has a diameter slightly less than the internal diameter of spindle 82 so that the coupler 98 may slide axially within the spindle. The rectangular opening 108 is sized to be slightly larger than the dimensions of that portion of plunger bar 74 between projections 102 and recesses 104. One face of coupler 98 abuts the projections 102 which are wider in one dimension than the opening 108.

A spring holder comprising two projections 110, 112 is provided on the opposite face of coupler 98 and hook spring 96 is mounted on the holder as shown in FIG. 4. Hook spring 96 comprises an arcuate portion 114 joining two legs 116 which converge toward each other, and two generally V-shaped portions 118 joined to legs 116 by two segments 120. The convergence of legs 116 is such that the legs must be spread apart in order to mount the hook spring on the holder. When so mounted, legs 116 extend parallel to, and grasp, projections 110 and 112 at the surfaces 124 and 126. The elbows 122 of the V-shaped portions 118 extend outwardly beyond the periphery of coupler 98 when the spring is mounted on the holder and the V-shaped portions are in a free or non-tensioned state. The distance between elbows 122 is greater than the internal diameter of inside spindle 82 so that the elbows must be pressed inwardly as the spring and coupler are inserted into the spindle. As subsequently explained, elbows 122 engage two opposing openings or slots 99 in spindle 82 when the lockset is in the locked position.

The spacing between surfaces 124 and 126 on projections 110, 112 is such that legs 116 of the spring 96 extend through the opposing slots 104 in the plunger bar 74 as the legs press inwardly toward the surfaces.

As will be evident from the following description, the plunger bar 74, hook spring 96 and coupler 98 always move together, both axially and rotationally. Therefore, the plunger bar, hook spring and coupler may be formed as a single monolithic plastic structure.

Figure 5:
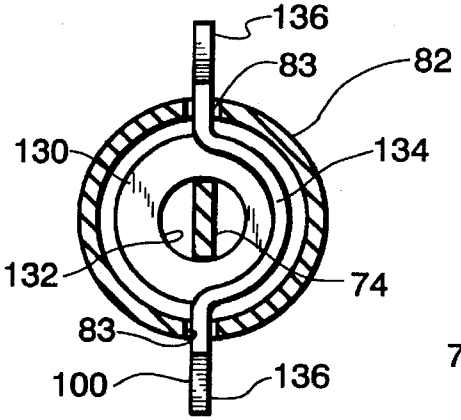
FIG. 5 is a sectional view, taken along the line 5—5 of FIG. 1, showing the locking slide and outside spindle.

Referring to FIGS. 3 and 5, the locking slide 100 comprises a hub 130 having a circular opening 132 therein. The diameter of opening 132 is slightly greater than the width of the plunger bar 74 in the region of the plunger bar to the left of projections 102 as viewed in FIG.3 so that the plunger bar may rotate relative to the locking slide. Locking slide 100 further comprises a semi-circular center portion 134 with two radially extending arms 136, the semi-circular portion joining the hub 130 around the edge of one face of the hub.

As shown in FIG. 1, arms of locking slide 100 extend through two opposing slots 83 provided in one end of inside spindle 82. In the unlocked state of the lockset (FIG. 1) the arms of locking slide 100 also extend through two opposing slots 137 provided in the cup-shaped left end portion of driver spindle 31 and are spaced from the outside chassis 80. Rotation of outside knob 84 is coupled via spindle 82, locking slide 100 and driver spindle 31 to the latch operating assembly 35 so that the door may be opened.

As the lockset is locked as subsequently described, the arms of locking slide 100 move out of slots 137 to uncouple the driver spindle 31 from the outside spindle 82 and outside knob 84. In the locked state the arms of locking slide 100 engage two slots 81 provided on the inside face of outside chassis 80 thereby preventing rotation of outside knob 84. The locking slide 100 thus serves as a clutch for selectively transmitting rotation of knob 84 to the driver spindle 31 or blocking rotation of knob 84 by coupling it to the stationary outside chassis 80.

When the plunger bar 74 is in a first or unlocked position as shown in FIG. 1 (push button 30 is not pressed in), the latch operating assembly 35 may be actuated to open the door by turning either knob 24 or 84. Rotation of knob 24 causes rotation of spindle 22 and cage 28. Because the opening 29 in cage 28 is rectangular and the driver spindle 31 is also rectangular, rotation of cage 28 causes the driver spindle to rotate thereby actuating the latch operating assembly 35 to retract the latch. On the other hand, if knob 84 is turned, it causes rotation of spindle 82 and the locking bar 100, because it extends through slots 83 and 137 in the spindles 82 and 31, transfers this rotation to driver spindle 31 to actuate the latch operating assembly 35 and retract the latch.

Rotation of driver spindle 31 in response to rotation of either knob 24 or 84 causes spring cage 28 to rotate thereby storing energy in torsion spring 26. The spring returns the lockset parts to their initial positions when the knob 24 or 84 is released.

The lockset may be locked by pressing the push button 30 into the knob 24. As the push button moves to the left, the arms of the caliper spring 32 are cammed toward each other by surfaces 58 on housing 34 and the end portions 72 of the spring engage teeth 73 on the plunger bar 74 thus moving the plunger bar to the left. The projections 102 on the plunger bar apply an axial force to the hub of locking slide 100 thus moving the locking slide to the left and out of the slots 137 in the end of driver spindle 31. This disconnects the outside spindle 82 from the driver spindle 31 so that rotation of outside knob 84 will not cause actuation of the latch operating assembly 35.

As the spindle 74 and locking slide 100 move to the left, the arms of the locking slide move into the slots 81 in the outside chassis 80, as shown in FIG. 2. At the same time, plunger bar 74 moves the coupler 98, hook spring 96 and washer 94 to the left, compressing spring 92. The left end of plunger bar 74 enters the opening 78 (FIG. 6) in the end of lock plug 79. Shortly thereafter, the hook spring 96 reaches a point opposite slots 99 in spindle 82 and the elbows 122 of the spring move outwardly into the openings. Coupler 98, hook spring 96 and the openings 99 in spindle 82 comprise a latching means for latching plunger bar 74 in this second position. The lockset is now locked and pressure may be removed from push button 30. Because locking slide 100 is engaged in the chassis slots 81 and extends through the slots 83 in spindle 82, the spindle 82 and knob 84 are locked against rotational movement.

Figure 6:
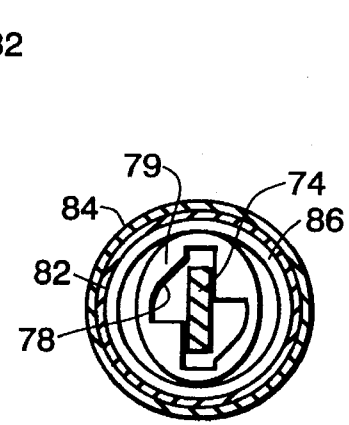
FIG. 6 is a sectional view, taken along the line 6—6 of FIG. 2, showing the end of the lock cylinder.

The lockset may be unlocked by either rotating the inside knob 24 or inserting a key into lock cylinder 86 and turning the key in a first direction to rotate lock plug 79 (FIG. 6). That is, knob 24 and lock cylinder 86 comprise a first and a second means, respectively, for unlatching the latching means. Rotation of the lock plug 79 or knob 24 causes rotation of the plunger bar 74. As the plunger bar rotates, the spring 96 rotates about the axis of the plunger bar and the elbows 122 of the spring move out of the slots 99 in spindle 82. The force stored in the compression spring 92 at the time of locking forces washer 94, coupler 98, locking slide 100 and plunger bar 74 axially to the right thus returning the plunger bar to its first or unlocked position. The locking slide moves out of slots 81 in the chassis 80 and into the slots 137 in driver spindle 31 thereby uncoupling the outside knob 84 from chassis 80 and re-connecting the outside knob to the driver spindle.

As the locking slide 100 moves to the right in response to the force of spring 92, it acts against projections 102 thus moving plunger bar 74 axially to the right and withdrawing the left end of the plunger bar from the opening 78 in lock plug 79. As the plunger bar moves to the right, it acts through caliper spring 32 to move the push button 30 to the right. When the camming portions 70 of the caliper spring reach the camming surfaces 58, the arms of the caliper spring open up and the plunger bar engaging portions are withdrawn from the notches in the plunger bar.

When the inside knob 24 is turned or the key is turned in the first direction to rotate the plunger bar 74 as indicated above, rotation of the plunger bar rotates push button housing 34 and, via projection 48, imparts rotation to inside spindle 22 and spring cage 28. This stores energy in the torsion spring 26. When the turning force on the knob or the key is removed, the energy stored in spring 26 rotates spindle 22, housing 34 and plunger bar 74. This restores the plunger bar 74 and spring 96 to their original angular orientation about the axis A so that the elbows 122 of the spring are again aligned with, but axially displaced from, the slots 99 in the spindle 82.

Figure 7A:
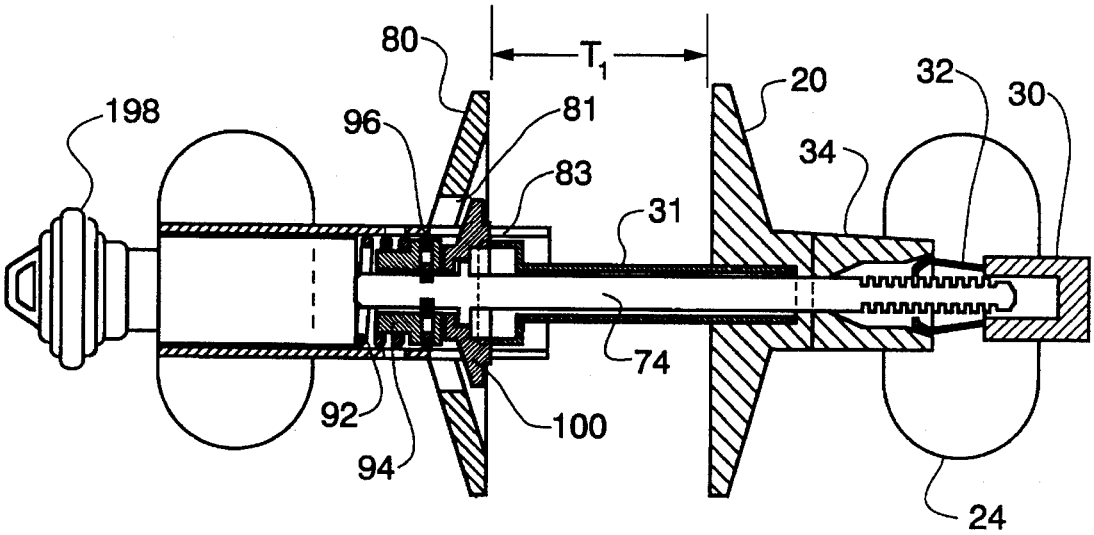
FIGS. 7A and 7B schematically illustrate the lockset in an unlocked state and a locked state, respectively, when mounted on a door having a first thickness.
Figure 7B:
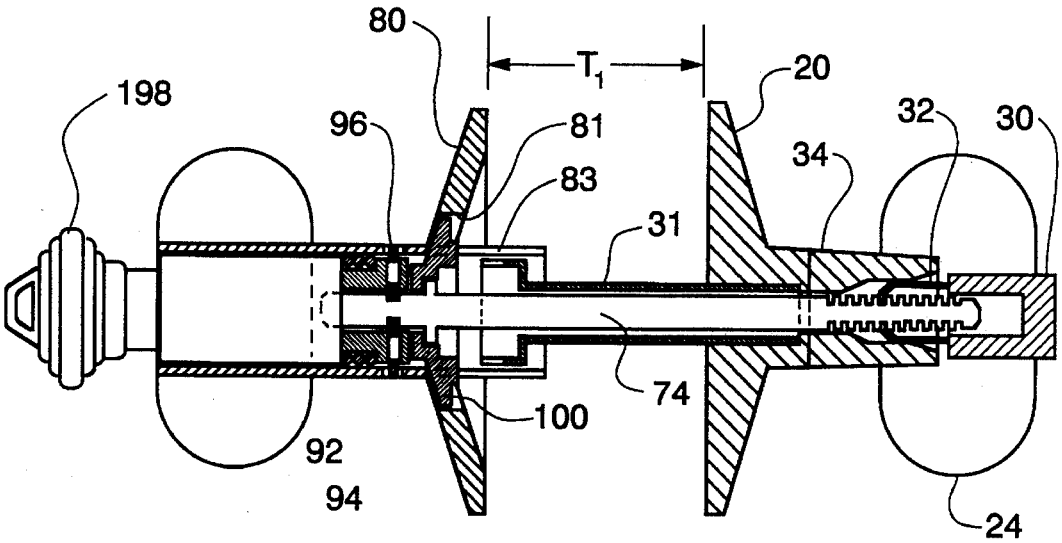
Figure 8A:
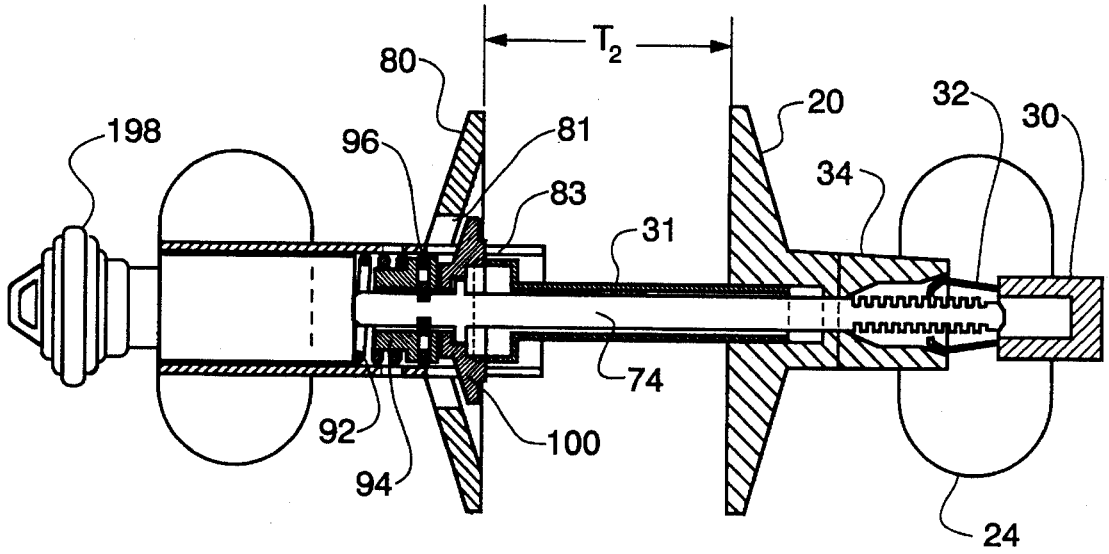
FIGS. 8A and 8B schematically illustrate the lockset in an unlocked state and a locked state, respectively, when mounted on a door having a second thickness greater than the first thickness.
Figure 8B:
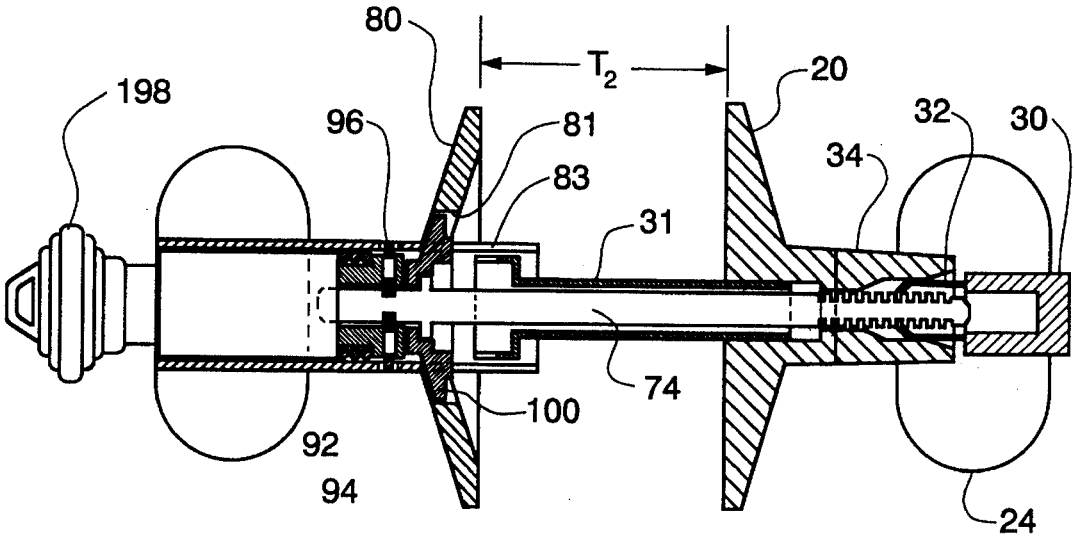

The arrangement of the push button 30, caliper spring 32, push button holder 34 and the teeth 73 on the plunger bar 74 makes the lockset shown in FIG. 1 suitable for use on doors of different thicknesses without modification or adjustment to adapt the lockset to the thickness of the door on which it is to be mounted. FIGS. 7A and 7B schematically illustrate the lockset in the unlocked and locked state respectively, when mounted on a door having a first thickness $T_1$ of say 1⅜". FIGS. 8A and 8B illustrate the lockset in the unlocked and locked state, respectively, when mounted on a door having a second thickness $T_2$ of say 1¾".

Since the left end of plunger bar 74 is held in the outside chassis assembly 16, the entire inside chassis assembly 10 is spaced closer to the right end of the plunger bar for doors of greater thickness. Therefore, as the push button 30 is pressed to lock the lockset, the caliper spring 32 will engage opposing notches closer to the right end of the plunger bar. The installer does not have to take heed of the door thickness because the adjustment occurs naturally as the inside chassis assembly is mounted on the door.

FIGS. 9–12 show a second, preferred embodiment of the lockset wherein unlocking is accomplished by causing relative rotation between the plunger bar and the hook spring and coupler. The relative rotation is brought about by rotating the inside knob to rotate the plunger bar while the hook spring and coupler are blocked against rotation, or by inserting a key into the outside lock cylinder and turning it to thereby rotate the hook spring and coupler while the plunger bar is biased against rotation.

Figure 9:
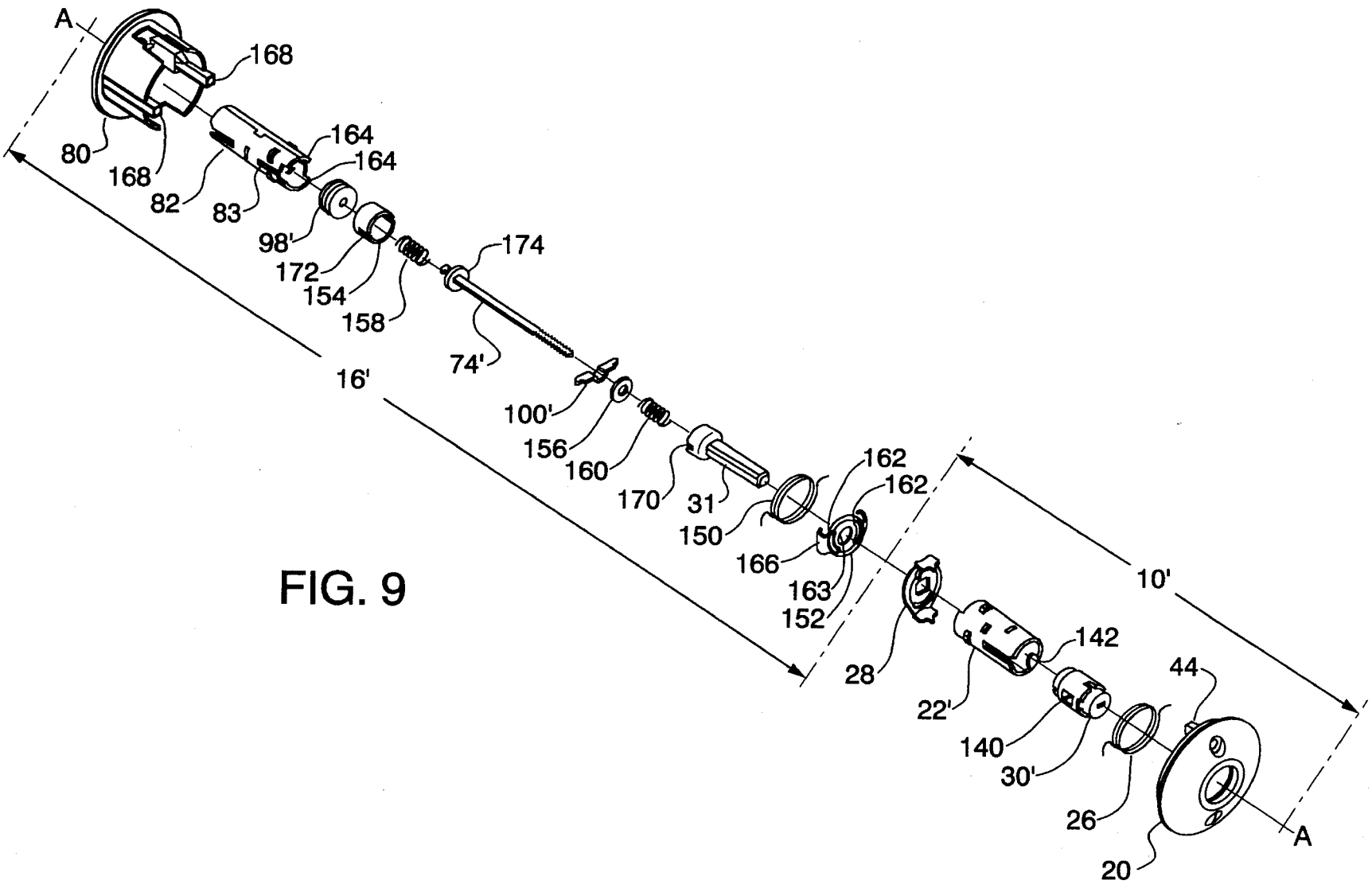
FIG. 9 is an exploded view of a second embodiment of a lockset according to the invention.
Figure 10:
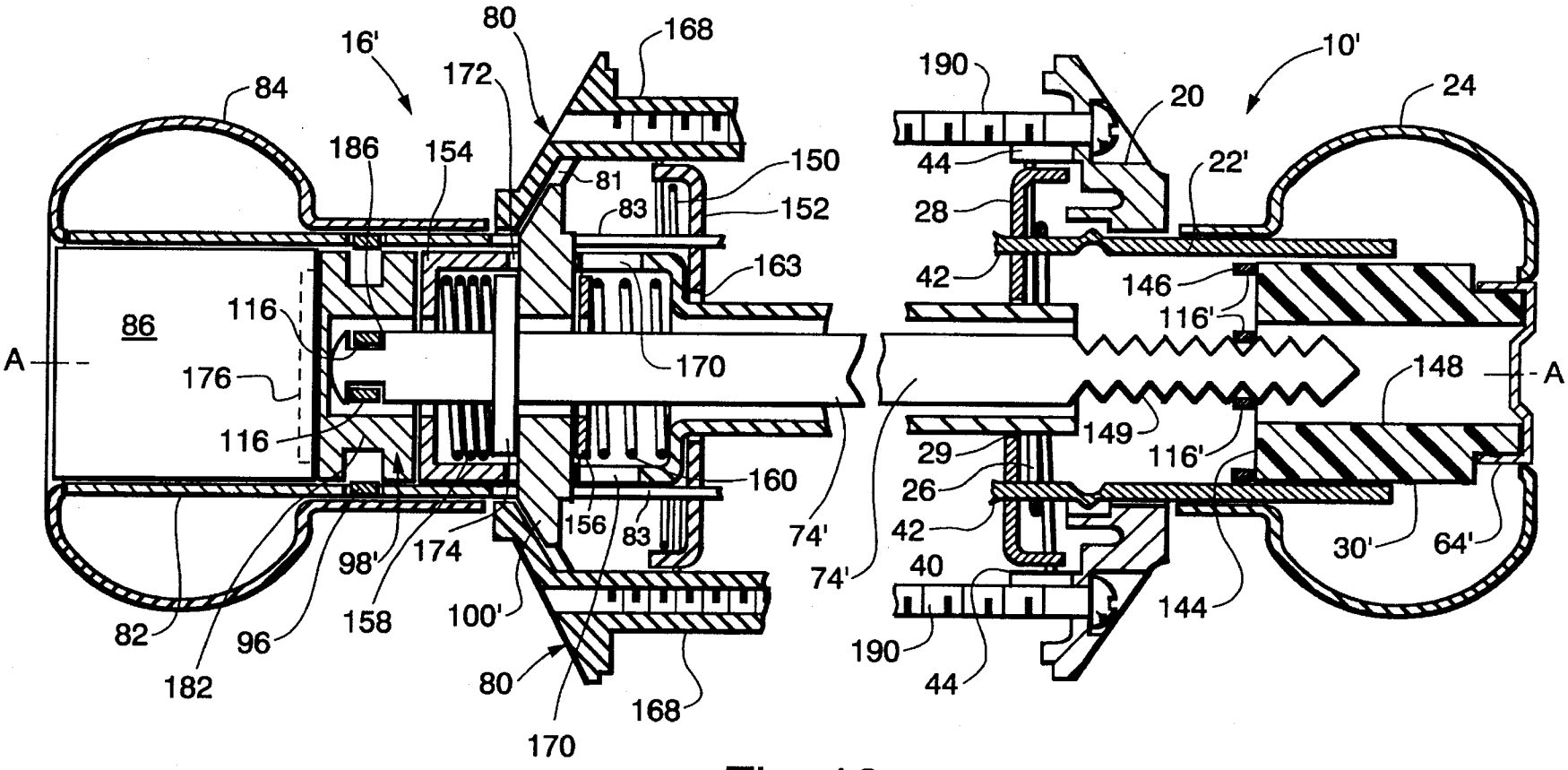
FIG. 10 is a sectional view of the second embodiment with the locking mechanism being shown in the locked state.

Referring to FIGS. 9 and 10, the lockset comprises an inside chassis assembly 10' and an outside chassis assembly 12'. The inside chassis assembly 10' comprises an inside chassis 20, an inside spindle 22', and inside knob 24, a torsion spring 26 and a spring cage 28 all arranged and cooperating as described with reference to the embodiment of FIG. 1.

The inside chassis assembly 10' further comprises a push button 30' mounted within spindle 22' and having one end extending through a central opening in knob 24. The push button may be a plastic member provided with a decorative cover 64'. Push button 30' is provided with two longitudinally extending slots 140 in its outer surface, one of the slots being visible in FIG. 9. After the push button is inserted into the spindle 22', an ear 142 on the spindle is bent inwardly and engages one of slots 140 to thereby permit limited axial movement of the push button within the spindle between a locked position wherein the right end of the push button extends a small distance out of the face of knob 24 and a locked position (FIG. 10) wherein the end of the push button is flush with the face of the knob.

The end surface 144 of push button 30' is provided with a spring holder in the form of two projections like the projections 110, 112 of FIG. 4. A hook spring 146, similar to the previously described hook spring 96 in shape, is mounted on the spring holder. The push button 30' is provided with an axially extending rectangular opening 148 for receiving an end portion of a rectangular plunger bar 74'. The arrangement is such that when the end of the plunger bar 74' is positioned in opening 148 the inner legs 116' of the hook spring 146 engage notches 149 provided on opposing edges of the bar. The force with which inner legs 116' grip the notches 149 is large enough to prevent the legs from slipping from one pair of opposing notches to the next when the push button 30' is pressed to axially move the plunger bar 74' against the force of a spring 158 as subsequently described.

The opening 148 is sized so that the plunger bar is rotated as the push button rotates but the plunger bar may move relative to the push button in the direction of axis A.

The inside chassis assembly 10' may be assembled by first inserting push button 30' into spindle 22' from the right and then bending the ear 142 on the spindle inwardly into the slot 140. The spindle is then inserted through the opening in chassis 20 from the left until ridges 40 engage the left side of the chassis. Torsion spring 26 is brought over the left end of spindle 22 with the ends of the spring behind locator troughs 44. The cage 28 is then mounted on the spindle ears 42 and the ears swaged to hold the assembly together. Knob 24 may be swaged to spindle 22 or a latch type coupling may be provided so that the knob and spindle rotate together.

The outside chassis assembly 16' comprises an outside chassis 80, an outside spindle 82 and an outside knob 84 all arranged and cooperating as described with reference to FIG. 1. The outside chassis assembly 16' further comprises a torsion spring 150, a spring cage 152, a hollow rectangular driver spindle 31, the rectangular plunger bar 74', a coupler 98', a locking slide 100', a spring housing 154, a spring washer 156, a plunger bar return spring 158, a locking slide drive spring 160, and a hook spring 96 (FIG. 10).

Torsion spring 150 surrounds outer spindle 82 and is retained on the spindle by spring cage 152. The spring cage has two arcuate slots 162 (FIG. 9) and two arcuate ears 164 on spindle 82 extend through these slots. The ears are swaged to hold the spring cage on the spindle. The ends of torsion spring 150 extend radially outward behind horizontally extending legs 166 provided on the spring cage and engage the back sides (as viewed in FIG. 10) of two screw-receiving locator posts 168 provided on chassis 80.

When outside knob 84 is turned to rotate spindle 82, the spindle rotates spring cage 152 and a leg 166 (FIG. 9) on the cage moves one end of spring 150. This stores energy in the spring which returns the knob to a home position when the knob is released.

As shown in FIG. 9, the locking slide 100' comprises two arms extending in opposite directions from a semi-circular portion, the latter being provided to permit passage of the plunger bar 74'. The arms of the locking slide are movable in opposing slots 83 which extend into spindle 82 from one end thereof. The cup-shaped end portion of driver spindle 31 has two opposing slots 170 extending in the axial direction into the spindle from its left end as viewed in FIG. 10 and spring holder 154 has two opposing slots 172 aligned with slots 170. The arms of locking slide 100' are moved back and forth in slots 170 and 172, as subsequently described, between an unlocked position (FIG. 11) wherein the arms of locking slide 100' are within slots 170 and spaced from slots 81 in the chassis, and a locked position (FIG. 10) wherein the arms are within slots 172 and engage the slots 81.

One end of locking slide drive spring 160 abuts the cup-shaped end portion of driver spindle 31 and the other end presses against washer 156. The washer is freely slidable on plunger bar 74' and abuts the locking slide 100' so the compressive force of spring 160 tends to urge the locking slide to the left as viewed in FIGS. 9–11.

Plunger bar 74' is provided with a circular portion 174 which abuts locking slide 100' and slides back and forth within spring holder 154. The plunger bar return spring 158 is disposed between portion 174 and the spring holder so the compressive force of this spring tends to move the locking slide and plunger bar to the right. Spring 158 is stronger than spring 160 so that when the lockset is unlocked, the spring 158 overcomes the force exerted on the locking slide 100' by spring 160 and moves the locking slide 100' to the right and into the slots 170 in the driver spindle 31.

Figure 12:
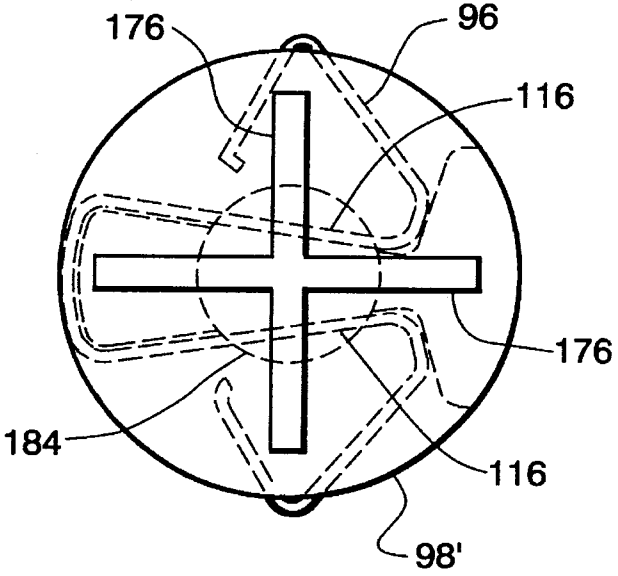
Figure 11:
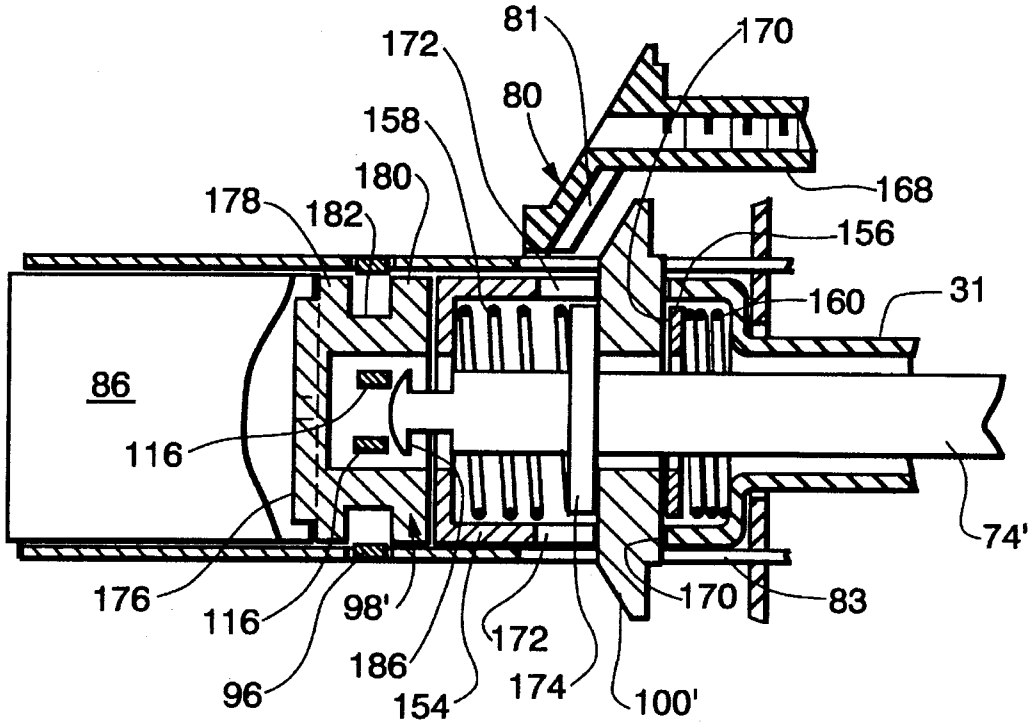
FIG. 11 is a part sectional view illustrating a portion of the outside chassis assembly in the unlocked state; and, FIG. 12 is an end view of the lock cylinder/plunger bar coupler.

Referring to FIGS. 11 and 12, the coupler 98' is provided with two generally circular outside portions 178, 180 joined together by a center spring holder portion 182. The circular portion 178 has two mutually perpendicular projections 176 extending outwardly to the left as viewed in FIG. 11. Projections 176 extend into the lock cylinder 86 and more particularly into the opening 78 (FIG. 6) in the end of lock plug 79. The projections engage the walls of the opening 78 so that the coupler 98' rotates when a key is inserted into the lock cylinder and turned to rotate the lock plug.

A circular opening 184 extends through coupler portions 180 and 182 and into portion 178. One end of plunger bar 74' extends into opening 184 and the opening is large enough to permit relative rotational movement between the plunger bar and the coupler 98' and axial movement of the plunger bar relative to the coupler. The force of spring 158 urges spring holder 154 and coupler 98' toward lock cylinder 86 so that the coupler does not move in the axial direction.

The spring holder portion 182 of coupler 98' has a shape similar to the projections 110, 112 (FIG. 4) of coupler 98 but the projections are separated by the circular opening 184. Hook spring 96 is mounted on the spring holder portion 182 and, with coupler 98' and spindle 82, comprises means for holding the plunger bar 74' in a second or locked position by engaging opposing notches 186 provided near one end of the plunger bar. As shown in FIG. 11, the spacing between the legs 116 of spring 96 is less than the widest dimension of the rectangular portion of the plunger bar 74'. Therefore, as the plunger bar is moved from a first or unlocked position (FIG. 11) toward its locked position (FIG. 10) the rounded end of the plunger bar first moves spring legs 116 apart and, after the rounded end portion has moved past the legs, the tension in the spring legs causes them to snap back into notches 186.

Referring to FIG. 10, the outside chassis assembly 16' may be assembled by inserting the spindle 82 through the opening in chassis 80 from the right until the ridges (not shown, but like inside spindle ridges 40) on the spindle engage the chassis. The lock cylinder 86 is then inserted into spindle 82 from the right. A conventional rib and groove arrangement (not shown) insures proper angular positioning of the lock cylinder within the spindle and limits movement of the lock cylinder to the left beyond a position where it is substantially flush with the face of knob 84. Next, the coupler 98' with hook spring 96 mounted thereon is inserted into spindle 82 with the projections 176 aligned so that they enter the opening 78 in lock plug 79. Spring holder 154 and spring 158 are then inserted into the spindle 82. Spring 160 and washer 156 are placed in the cup-shaped portion of driver spindle 31 and the plunger bar 74' is then inserted through the driver spindle from the left. The locking slide 100' is positioned between the washer 156 and the circular portion 174 of the plunger bar and the plunger bar/driver spindle/locking slide assembly is inserted into spindle 82 from the right with the locking slide being aligned so as to enter the slots 83 in the spindle. Torsion spring 150 is brought over the right end of spindle 82 with the ends of the spring behind the screw-receiving locator posts 168. Spring cage 152 is then mounted on spindle 82 with ears 164 (FIG. 9) of the spindle extending through slots 162 in the spindle cage. The ears 164 are then swaged to thereby hold the assembled parts together. Finally, the knob 84 is mounted on the left end of spindle 82 and the spindle and knob swaged to hold them together.

The embodiment of FIGS. 10–12 operates as follows. When the lockset is in its unlocked state it may be locked only by pressing the push button 30' so that it moves axially to the left as viewed in FIG. 10. This motion is transmitted to plunger bar 74' via the engagement of hook spring 146 with the teeth 149 on the plunger bar. As the plunger bar moves to the left, the circular portion 174 of the plunger bar compresses spring 158 as the rounded left end of the plunger bar moves between, and separates, the legs 116 of hook spring 96. At the same time, spring 160 urges locking slide 100' to the left so that the locking slide follows the circular portion 174 of the plunger bar and begins moving out of the slots 170 in driver spindle 31 and into the slots 172 in spring holder 154. As push button 30' reaches a locking position, the hook spring legs 116 clear the rounded end portion of plunger bar 74' and snap into notches 186 thereby latching the plunger bar in its second or locked position. The lockset is now locked and the pressure on the push button may be released. The locking slide is now completely out of the slots 170 in driver spindle 31 so the outside knob 84 is completely disconnected from the driver spindle. Furthermore, turning of the outside knob is prevented because the spindle 82 turns with the outside knob and the locking slide, which extends through slots in the spindle, is now engaged with slots 81 in outside chassis 80.

When the lockset is in its locked state it may be unlocked from the outside with a key or from the inside by turning the inside knob 24. When a key is inserted into lock cylinder 86 and turned to rotate lock plug 79, the walls of lock plug opening 78 engage projections 176 on coupler 98' and rotate the coupler and hook spring 96. As the hook spring rotates relative to plunger bar 74' the hook spring legs 116 move out of notches 186 in the plunger bar so that the plunger bar is no longer held by the spring. Spring 158 acts against the circular portion 174 of the plunger bar to move the plunger bar and locking slide 100' to the right against the force of weaker spring 160. As the plunger bar moves to the right, teeth 149 on the plunger bar act against legs 116' on the spring 146 to move the push button 30' to the right.

The locking slide 100' is moved to the right until it engages the driver spindle 31 at the ends of the slots 170 in the driver spindle. At this time the push button extends out of the inside knob a short distance (about ¼") and the locking slide is within slots 170 and completely free of spring holder slots 172 and chassis slots 81. The door on which the lockset is mounted may now be opened by turning outside knob 84 to rotate spindle 82. Since the locking slide now engages slots 83 in spindle 82 and slots 170 in driver spindle 31, rotation of spindle 82 causes a corresponding rotation of the driver spindle. Although not shown in FIGS. 9 and 10, it will be understood that the embodiment shown in these figures is provided with a latch operating assembly, like the assembly 35 of FIG. 1, which is responsive to rotation of driver spindle 31 to retract a door latch.

Since the lockset may be locked only by moving the plunger bar 74' axially and since it is not possible to impart movement to the plunger bar in the axial locking direction by turning a key in lock cylinder 86, it is not possible to lock the lockset from the outside.

As previously indicated, the lockset of FIGS. 9 and 10 may be unlocked from the inside by turning the inside knob 24. When inside knob 24 is turned it rotates inside spindle 22. The rotary motion of the spindle is transmitted via spring cage 28 and driver spindle 31 to the latch operating assembly to retract the latch.

The rotary motion of spindle 22 is also transmitted via the spindle ear 142 to push button 30' thereby rotating the push button and plunger bar 74'. As the plunger bar rotates, the legs 116 of hook spring 96 slip free of the notches 186 in the plunger bar and spring 158 returns the locking slide 100', plunger bar 74' and push button 30' to their unlocked state in the same manner as described above for unlocking the lockset with a key.

From the above description it is seen that in the second embodiment the lock cylinder 86 comprises a first means and inside knob 24, inside spindle 22' and push button 30' comprise a second means for unlatching the latching means or hook spring 96 from the plunger bar 74' so that the plunger bar may move from its second or locked position to its first or unlocked position. Both the first and second unlatching means accomplish the unlatching by rotating the plunger bar relative to the hook spring.

The embodiment of FIGS. 9 and 10 has an advantage in that it permits so-called "hands free" installation in addition to automatically adjusting to the thickness of the door on which it is mounted. To mount the lockset on a door, the outside chassis assembly 16' is inserted into an opening in the door until the outside chassis 80 is against the outside surface of the door. The inside chassis assembly 10' is then moved toward the inside surface of the door with plunger bar 74' aligned with the opening 148 in push button 30'. As the outside chassis assembly is moved toward the door, the right end of the plunger bar forces the legs 116' of the hook spring 146 apart and enters the opening 148.

As soon as the hook spring legs 116' engage the recess between the two end-most teeth 149 of the plunger bar the inside and outside chassis assemblies are connected and the installer may release either or both assemblies without fear that they will separate and fall. The installer then has both hands free to make the final alignment so that screws 190 may be inserted through the inside chassis and screwed into the screw-receiving locator posts 168 of the outside chassis to draw the inside and outside chassis 20 and 80 against the inside and outside surfaces, respectively, of the door.

The push button is then pressed into knob 24 until the inward movement of the push button is stopped by engagement of the spindle ear 142 with the end of push button slot 140. At this time the push button is flush with the knob 24. The pressing of the push button first moves plunger bar 74' to the locking position and after hook spring 96 engages the notches 186 in the plunger bar the legs 116' of hook spring 146 slip from one pair of teeth 149 to another until ear 142 engages the end of slot 140. This automatically adjusts the lockset to the thickness of the door on which it is being mounted.

When the installation is completed the lockset is in the locked state. It may then be unlocked as previously described by turning a key in the lock cylinder 86, or by turning the knob 24.

Although the preferred embodiments of the invention have been described as having knobs, it will be understood that insofar as the present invention is concerned handles or levers may be substituted for the described knobs as manually actuated operators for the lockset. Other modifications and substitutions may be made in the described embodiments without departing from the spirit and scope of the invention as defined by the appended claims.

We claim:

1. A lockset for a door, said lockset comprising:

an outside chassis and an inside chassis;

an outside spindle and an inside spindle, said outside spindle and said inside spindle being mounted in said outside chassis and said inside chassis, respectively, for rotation about a common axis;

a hollow driver spindle rotatable about said axis for driving a latch operating assembly;

a locking slide movable along said axis between an unlocked position in which said locking slide connects said outside spindle in driving relationship with said driver spindle and a locked position wherein said outside spindle is disconnected from said driver spindle;

a plunger bar having a rectangular section, said plunger bar being movable along said axis between a first position and a second position, said plunger bar extending through said driver spindle and having a first end portion extending into said outside spindle and at least one notch located in said first end portion;

a push button coupled to said plunger bar for moving said plunger bar from said first position to said second position as a manual force is applied to said push button;

means for moving said locking slide from said unlocked position to said locked position as said plunger bar is moved from said first position to said second position;

latching means for holding said plunger bar in said second position after the manual pressure is removed from said push button, said latching means including a coupler movably disposed in said outside spindle and a hook spring mounted on said coupler for movement therewith, said hook spring having a leg engaging said notch;

means for unlatching said latching means to permit movement of said plunger bar to said first position; and, a return spring for moving said plunger bar from said second position to said first position when said latching means is unlatched, said return spring also moving said locking slide from said locked position to said unlocked position.

2. A lockset as claimed in claim 1 wherein said coupler is mounted on said plunger bar so as to move therewith, said hook spring having at least one elbow which engages at least one slot in said outside spindle to latch said plunger bar in said second position.

3. A lockset as claimed in claim 2 wherein said hook spring has two legs for engaging two notches on opposite sides of said plunger bar and two elbows for engaging two slots in said outside spindle, the two legs of said hook spring being spaced apart by a distance less than the distance between said opposite sides.

4. A lockset as claimed in claim 3 wherein said coupler has projections on one face thereof for holding said hook spring and a rectangular opening through which said plunger bar extends, said projections being shaped so as to hold said hook spring with said two legs spaced apart and extending over said rectangular opening in said coupler.

5. A lockset as claimed in claim 2 wherein said means for unlatching said latching means includes means responsive to rotation of said inside spindle for rotating said plunger bar whereby said coupler rotates to disengage said elbow from said slot.

6. A lockset as claimed in claim 2 wherein said means for unlatching said latching means comprises a lock cylinder disposed in said outside spindle, said lock cylinder including a lock plug rotatable in response to insertion and turning of a key, said lock plug having an opening in an end face thereof, an end of said plunger bar extending into said opening in said end face to engage said lock plug whereby rotation of said lock plug causes rotation of said plunger bar and said coupler to disengage the elbow of said hook spring from the slot in said outside spindle.

7. A lockset as claimed in claim 5 wherein said means for unlatching said latching means comprises a lock cylinder disposed in said outside spindle, said lock cylinder including a lock plug rotatable in response to insertion and turning of a key, said lock plug having an opening in an end face thereof, an end of said plunger bar extending into said opening in said end face to engage said lock plug whereby rotation of said lock plug causes rotation of said plunger bar and said coupler to disengage the elbow of said hook spring from the slot in said outside spindle.

8. A lockset as claimed in claim 2 wherein said return spring is a compression spring surrounding said plunger bar and disposed between said coupler and said lock cylinder.

9. A lockset as claimed in claim 8 wherein said locking slide has an opening therein through which said plunger extends, said opening being large enough to permit rotation of said plunger bar relative to said locking slide, said means for moving said locking slide comprising a projection on said plunger bar for engaging said locking slide.

10. A lockset as claimed in claim 9 wherein said outside spindle and said driver spindle are each provided with a pair of slots and said outside chassis has at least one chassis slot, said locking slide being positioned in the slots of the driver spindle and the outside spindle when the locking slide is in said unlock position, said locking slide being positioned in the slots of the outside spindle and the chassis slot when the locking slide is in said locked position.

11. A lockset as claimed in claim 5 wherein the means responsive to rotation of the inside spindle for rotating the plunger bar comprises a button holder mounted in said inside spindle so as to rotate therewith, said button holder having a rectangular opening into which said plunger bar extends.

12. A lockset as claimed in claim 11 wherein said rectangular opening in said button holder has opposing camming surfaces sloping toward said axis from an end of said holder and said push button has a caliper spring attached thereto, said caliper spring having two arms which are cammed toward said axis by said camming surfaces as said manual force is applied to said push button, whereby ends of the caliper spring arms engage teeth provided on said plunger bar as said manual force is applied to said push button.

13. A lockset as claimed in claim 1 wherein said coupler has an opening therein into which said plunger extends, said opening in said coupler being large enough to permit relative rotational movement between said coupler and said plunger bar and movement of said plunger bar relative to said coupler as said plunger is moved between said first and second positions.

14. A lockset as claimed in claim 13 wherein said hook spring has two legs for engaging two notches provided on opposite sides of said plunger bar to latch said plunger bar in said second position.

15. A lockset as claimed in claim 14 wherein said coupler includes a holder for holding said hook spring with the legs of the hook spring spread apart by a distance less than the distance between said opposite sides of said plunger bar.

16. A lockset as claimed in claim 15 wherein said plunger bar has an end shaped to spread the legs of the hook spring as the plunger bar is moved toward said second position, the legs of the hook spring being tensioned so as to snap into said two notches when said plunger bar reaches said second position.

17. A lockset as claimed in claim 16 wherein said means for unlatching said latching means includes means responsive to rotation of said inside spindle for rotating said plunger bar relative to said coupler and hook spring to disengage said the legs of said hook spring from the notches in the plunger bar.

18. A lockset as claimed in claim 15 wherein said means for unlatching said latching means comprises a lock cylinder disposed in said outside spindle, said lock cylinder including a lock plug rotatable in response to insertion and turning of a key, said lock plug having an opening in an end face thereof, said coupler having projections thereon extending into said opening in said end face to engage said lock plug whereby rotation of said lock plug causes rotation of said coupler and hook spring relative to said plunger bar to disengage the legs of said hook spring from the notches on said plunger bar.

19. A lockset as claimed in claim 1 wherein said plunger bar includes a circular portion and said return spring is a compression spring surrounding said plunger bar and disposed between said circular portion and said coupler.

20. A lockset as claimed in claim 19 wherein said outside spindle and said driver spindle are each provided with a pair of slots and said outside chassis has at least one chassis slot, said locking slide being positioned in the slots of the driver spindle and the outside spindle when the locking slide is in said unlock position, said locking slide being positioned in the slots of the outside spindle and the chassis slot when the locking slide is in said locked position.

21. A lockset as claimed in claim 20 wherein said driver spindle has a cup-shaped end portion and said locking slide is disposed adjacent said circular portion of said plunger bar, said means for moving said locking slide from said unlocked position to said locked position comprising a locking slide drive spring disposed in said cup-like end portion for urging said locking slide against said circular portion of the plunger bar.

22. A lockset as claimed in claim 1 wherein the means responsive to rotation of the inside spindle for rotating the plunger bar comprises said push button.

23. A lockset as claimed in claim 22 wherein an ear provided on said inside spindle engages a slot provided on said push button so that rotation of the inside spindle causes rotation of the push button, said push button having a rectangular opening therein into which said plunger bar extends.

24. In a lockset having:

an outside chassis assembly for mounting on the outside of a door and including a plunger bar movable along an axis from a first position to a second position to prevent operation of the lockset from outside the door, the lockset also having an inside chassis assembly for mounting on the inside of the door and including a push button to which a manual force may be applied to move the plunger bar from the first to the second position, the improvement wherein:

a spring means is provided for drivingly coupling the push button to the plunger bar by engaging one pair of a plurality of pairs of teeth provided on the plunger bar, whereby said lockset may be mounted, without adjustment, on doors of different thicknesses.

25. The improvement as claimed in claim 24 wherein an opening is provided in the housing for receiving an end of the plunger bar, the opening being bounded on two sides by camming surfaces, said spring means comprising two arms extending from the push button toward the camming surfaces whereby the camming surfaces cam the two arms into respective teeth of one pair of said pairs of teeth.

26. The improvement as claimed in claim 24 wherein an opening is provided in the push button for receiving an end of the plunger bar and the push button is provided with a spring holder, said spring means being mounted on said spring holder and comprising a hook spring having first and second legs spaced apart by a distance such that a tapered end of the plunger bar may be forced between said first and second legs as said inside chassis assembly and said outside chassis assembly are moved against said door with said plunger bar aligned with the opening in the push button.

* * * * *